United States Patent [19]

Cullen et al.

[11] 4,039,237

[45] Aug. 2, 1977

[54] ELECTRICAL POWER CONDUCTOR APPARATUS FOR EARTH BORING

[75] Inventors: Roy H. Cullen, Houston; Jimmie R. Aker, League City, both of Tex.

[73] Assignee: Roy H. Cullen

[21] Appl. No.: 649,246

[22] Filed: Jan. 15, 1976

Related U.S. Application Data

[60] Continuation-in-part of Ser. No. 554,753, March 3, 1975, abandoned, which is a division of Ser. No. 448,975, March 7, 1974, Pat. No. 3,886,241.

[51] Int. Cl.[2] ..... H01R 13/54

[52] U.S. Cl. ..... 339/91 R; 339/16 R

[58] Field of Search ..... 339/16 R, 16 C, 45 R, 339/91 R, 44 R, 44 M, 96; 294/86.17, 86.18, 86.22, 86.28, 86.32; 166/123, 125, 134

[56] References Cited

U.S. PATENT DOCUMENTS

| | | | |
|---|---|---|---|
| 1,872,111 | 8/1932 | Bricken | 339/91 R |
| 2,339,274 | 1/1944 | Kothny | 339/91 R |
| 3,378,811 | 4/1968 | Cullen et al. | 339/96 |
| 3,628,822 | 12/1971 | Bostock | 294/86.18 |

*Primary Examiner*—Roy Lake
*Assistant Examiner*—E. F. Desmond
*Attorney, Agent, or Firm*—Pravel, Wilson & Gambrell

[57] ABSTRACT

Electrical power conductor apparatus for earth boring using a rotary drilling rig and drilling string for mounting a bottom hole electrical motor to rotate a drill bit to form the borehole with electrical power from an electrical power source at the earth surface communicated to the electrical motor by conductor lines positioned in the bore of the drill string and having releasable supporting connectors to enable adding and removing of lengths of conductor lines as desired. The conductor apparatus includes electrical conductors having upper and lower plugs with the upper plug releasably securable with the drilling string and releasable by engagement with a fishing tool to remove the conductor from the drilling string.

27 Claims, 15 Drawing Figures

H
E
D
E1
E2
I
I2
14
37
37a
S
29
30a
U
32
36
46a
46b
46c
47
12
X
A
K
49
R
V
50
70
60
C
84
80
86
82
F
Y
G
91
92
F
90
Y
A
230
242a
220
206b
244
206
224
224b
202
220c
C
139
139
F
Y
A
104
130
142a
142b
106a
120b
102
106
C
124
120c
116
M
W
Z
B
P

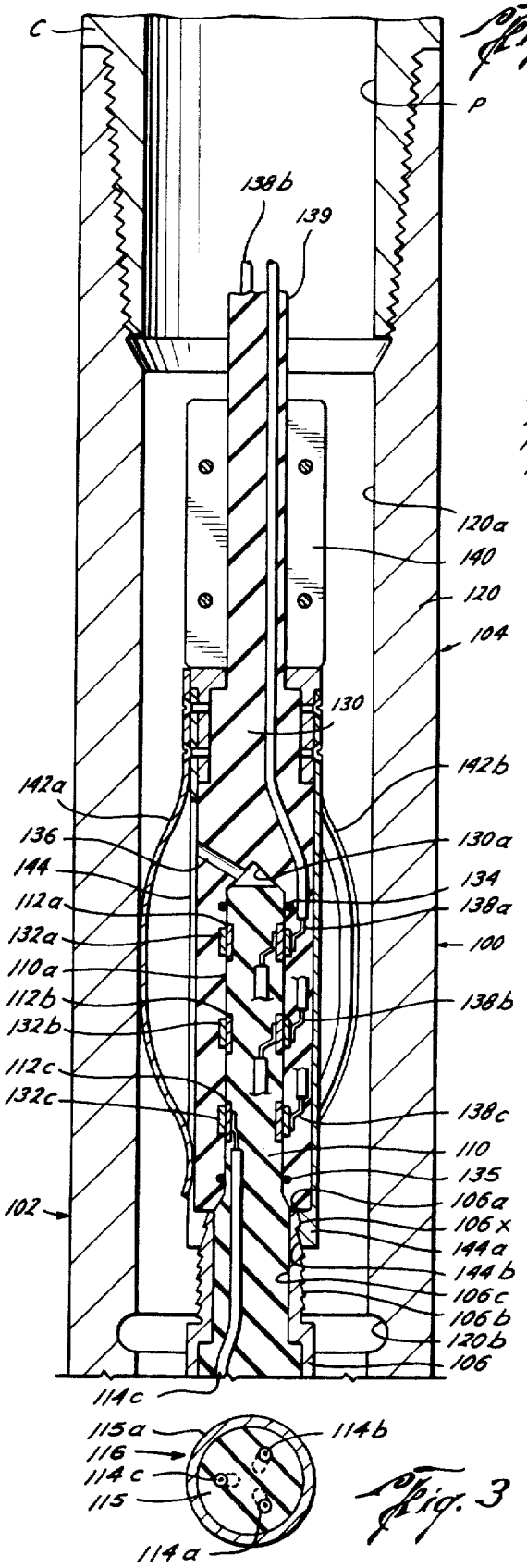
Fig. 2A
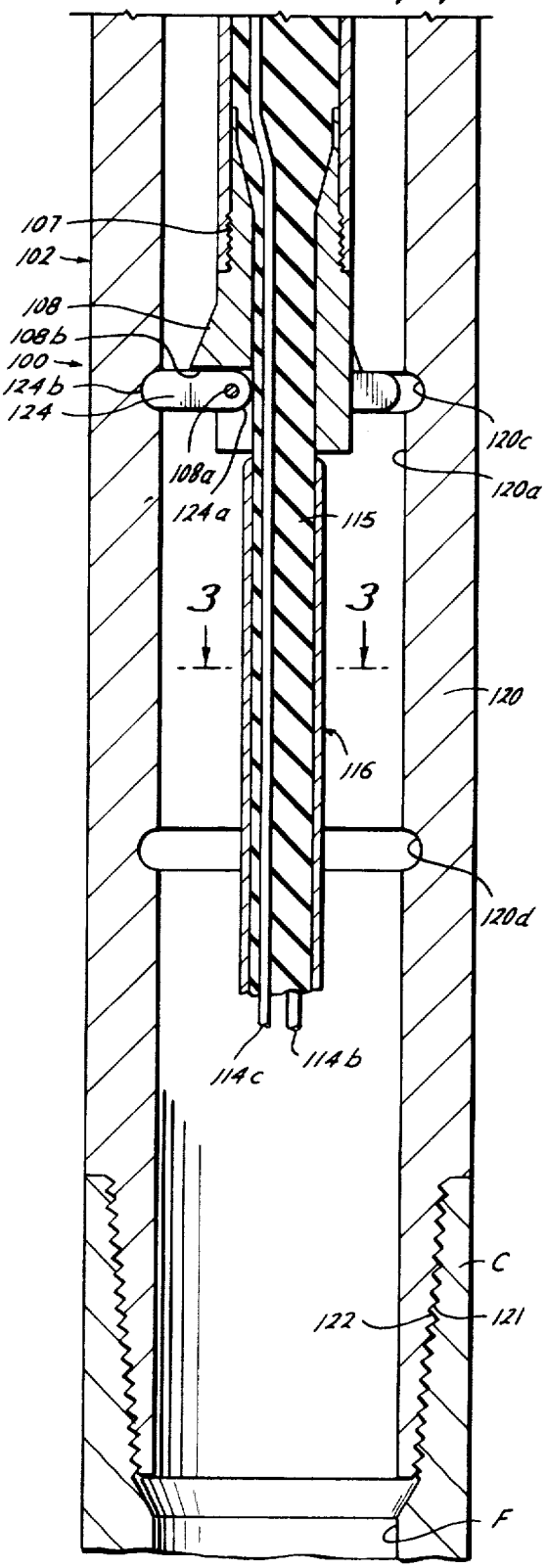
Fig. 2B
Fig. 3

ELECTRICAL POWER CONDUCTOR APPARATUS FOR EARTH BORING

CROSS-REFERENCE TO RELATED APPLICATION

This application is a continuation-in-part of application Ser. No. 554,753, filed Mar. 3, 1975 now abandoned which is a division of application Ser. No. 448,975, filed Mar. 7, 1974, now U.S. Pat. No. 3,886,241.

BACKGROUND OF THE INVENTION

This invention relates broadly to the field of earth boring and more particularly to earth boring by a drill bit driven by a downhole electric motor supplied with electrical power from the surface.

The continuing search for supplies of oil and gas has recently resulted in the drilling of wells to greater depths than has been the previous practice. At these relative greater depths, 10,000 feet or about 2 miles and below, the standard rotary drilling rigs have previously been limited in drilling capability, since the length of the tubular drilling string severely limited the rotational speeds at which the drilling bit was rotated. This was primarily due to risk of twisting off the drilling string in the borehole and the resulting loss of time to recover the drill bit and lower portion of the string or loss of the borehole itself. Below 15,000 feet, for example, drillers have been hesitant to rotate the drilling string at more than 35 r.p.m.

At such low drill bit rotational speeds, the long life diamond drilling bits used at such depths to minimize the frequency of replacement have characteristically had low formation penetration rates as such bits usually achieve maximum economic formation penetration when rotated at speeds in the range of 400 -800 r.p.m.

Some prior art attempts to improve drilling operations using downhole motors to rotate the drill bits at high speed include U.S. Pat. Nos. 2,531,120; 2,803,433 and 3,007,534. The latter patent employs an electrical swivel for rotating a transmission power cable with the drilling string, but the cable is carried exteriorly of the drill string where it is easily damaged by contact with the borehole walls. The U.S. Pat. Nos. 2,531,120 and 3,696,332 Pats. disclose drill pipe having electrical conductors formed integral therein which automatically connect electrically when the drill pipe is made up in the drilling string, but such numerous connections increase the electrical resistancce and decrease the power communicated to the drilling motor. U.S. Pat. No. 3,280,923 attempts to avoid the problem of supplying power to the bit motor by employing a special nuclear reactor downhole to generate the electrical power for the bit motor.

Three U.S. Pat., Nos. 3,285,629; 3,372,762 and 3,777,827 disclose electrical drilling systems employing flexible hose as the drilling fluid circulating pipe instead of the standard tubular drill string and the electrical connections are made at the same time as the 500feet long sections of flex hose are connected. Such an arrangement has not been particularly suitable for use with the standard joints of drill pipe in deep drilling, since the additional time needed in making the large number of connections required has been very costly.

U.S. Pat. No. 3,378,811 disclosed an electrical connector system by which an electrical connector may pass downwardly through the bore of a plurality of previously connected drill pipes for establishing a downhole electrical connection to avoid the necessity of using separate sections of electrical cable for each section of drill pipe. Electrical connectors for use in an oil field environment have also been disclosed in U.S. Pat. Nos. 3,657,681 and 3,753,206 while the electrical connector disclosed in U.S. Pat. No. 3,714,384 was directed for use in submerged oil and gas production systems.

Additional patent disclosures directed to making an electrical connection in a hostile environment include U.S. Pat. Nos. 3,398,392; 3,522,576; 3,596,231; 3,643,207 and 3,729,699.

SUMMARY OF THE INVENTION

This invention relates to a new and improved method and apparatus for earth boring using a standard rotary drilling string and drilling rig for mounting an electrical motor to rotate a drilling bit mounted on the lower end of the drilling string to form the borehole. Electrical power for the motor is supplied from the surface through a power conductor means installed in the bore of the drilling string and which is connected to the supply or source of electrical power by an electrical swivel unit to enable drill string rotation and a movable conductor element to make electrical contact with the conductor means compensating for variations in length of the conductor means and the drilling string. The conductor means having mating plug means to enable lengthening of the power conductor means as drill pipe is added to the drilling string and for supporting a length of the conductor means in bore of the drilling string.

BRIEF DESCRIPTION OF THE DRAWINGS

FIGS. 2A and 2B are side views, in section, illustrating in detail an electrical connector apparatus of the present invention operably positioned in the bore of the drilling string with the views arranged in alphabetical sequence from top to bottom of the connector apparatus;

FIG. 3 is a view taken along line 3-3 of FIG. 2B;

DESCRIPTION OF THE PREFERRED EMBODIMENTS

Figures 1A, 1B, 1C:
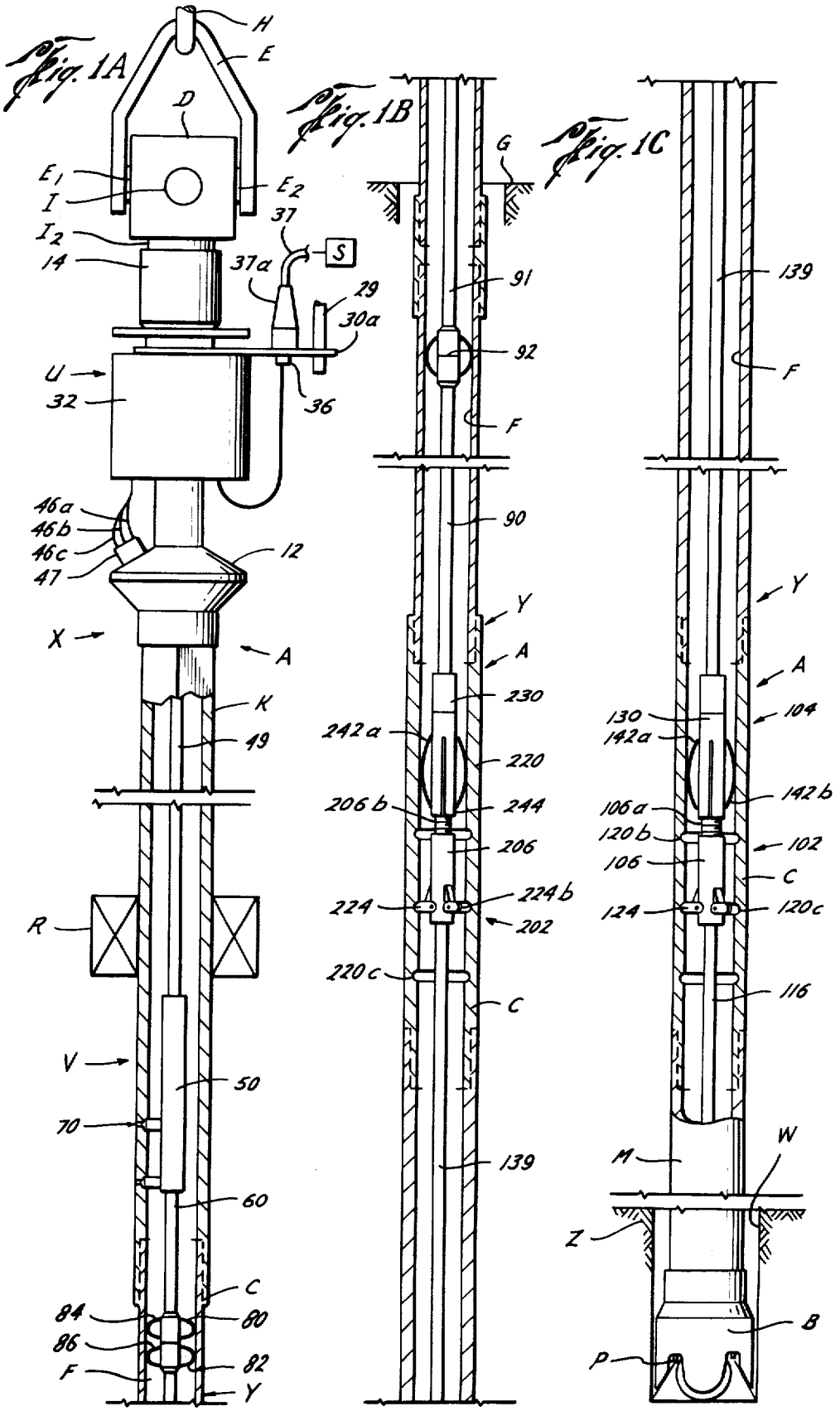
FIGS. 1A, 1B and 1C are side views, substantially in section, illustrating the earth boring apparatus of the present invention operably positioned in a borehole with the views arranged in alphabetical sequence from top to bottom of the earth boring apparatus.

The earth boring apparatus of the present invention, generally designated A, is schematically illustrated in FIGS. 1A, 1B and 1C with the rotary drill bit B (FIG. 1C) mounted at the lower end of a drilling string well conduit C which is supported by the travelling block hook H (FIG. 1A) in the usual manner of rotary drilling operations. The travelling block cooperates with the crown block (not illustrated) rotatably mounted on the derrick (not illustrated) to provide a pulley arrangement connected by a flexible cable (not illustrated) for lifting or lowering of the drilling string C and the drill bit B during drilling operations as is well known in the art. The travelling block hook H engages and supports a swivel support bracket E which pivotally connects at its lower ends E1 and E2 with the drilling fluid swivel unit D in the usual and well known manner. The drilling fluid swivel D is provided with inlet connection I for enabling communication of drilling fluid from the mud pumps or other source of drilling fluid (not illustrated) for circulating drilling fluid downwardly through the drilling string C and outwardly through the plurality of ports P in the drill bit D in the usual manner.

A kelly K is connected in the drilling C and forms an integral portion thereof adjacent a rotary table R which engages the kelly in the well known manner for effecting rotation of the drilling string C. The kelly K is arranged for moving downwardly through the rotary table R as the rotating drill bit B moves deeper into the formation Z. Of course, a power swivel as well known to those skilled in the art may be employed to rotate the drilling string in place of the kelly K and rotary table R without departing from the present invention.

In the present invention, the drill bit B is rotated by a downhole electrical motor M (FIG. 1C) mounted in the drill string C above the drill bit B independently of the rotation of the drill string C by the rotary table R. Detail disclosure of a downhole drill bit electric motor M may be found in U.S. Pat. Nos. 3,285,629 and 3,372,762 and reference is hereby made to those disclosures for incorporating herein a more complete disclosure of the drilling motor M and the operating mechanical connection with the drill bit B to effect desired rotation thereof. Of course, the drill bit B may be connected with the electric motor M in any number of suitable arrangements to form a unit without departing from the scope of the present invention. Controlled electrical power is selectively supplied from a source S (FIG. 1A) located above the ground surface G through an electrical connector system, generally designated X, and an electrical conductor system, generally designated Y which electrically connects with the electrical motor M. Any source of electrical power S compatible with the electrical motor M may be employed with the present invention, though in practice a portable internal combustion engine driven generator unit is preferably employed. In a typical aplication a three wire system supplying a maximum of 75 amps at 3000 volts is used to drive the frequency controlled electric motor M to rotate the drill bit B at rotational speeds of 35 to 800 r.p.m. to achieve the maximum efficient penetration of the formation Z with the drilling bit B.

As best illustrated in FIG. 1A, the electrical connector system X includes an electrical swivel or slip join unit U connected in the drilling string C between the drilling fluid swivel D and the kelly K. The connector system X further includes a movable connector means V disposed in the kelly for connecting with the electrical conductor system Y after the kelly K is made up in the drilling string C. The electrical conductor system Y is disposed in a bore F of the drilling string C and extends downwardly from the connector system X to the electrical motor M for transmitting the electrical power from the source S at the surface to the motor M.

Figure 6:
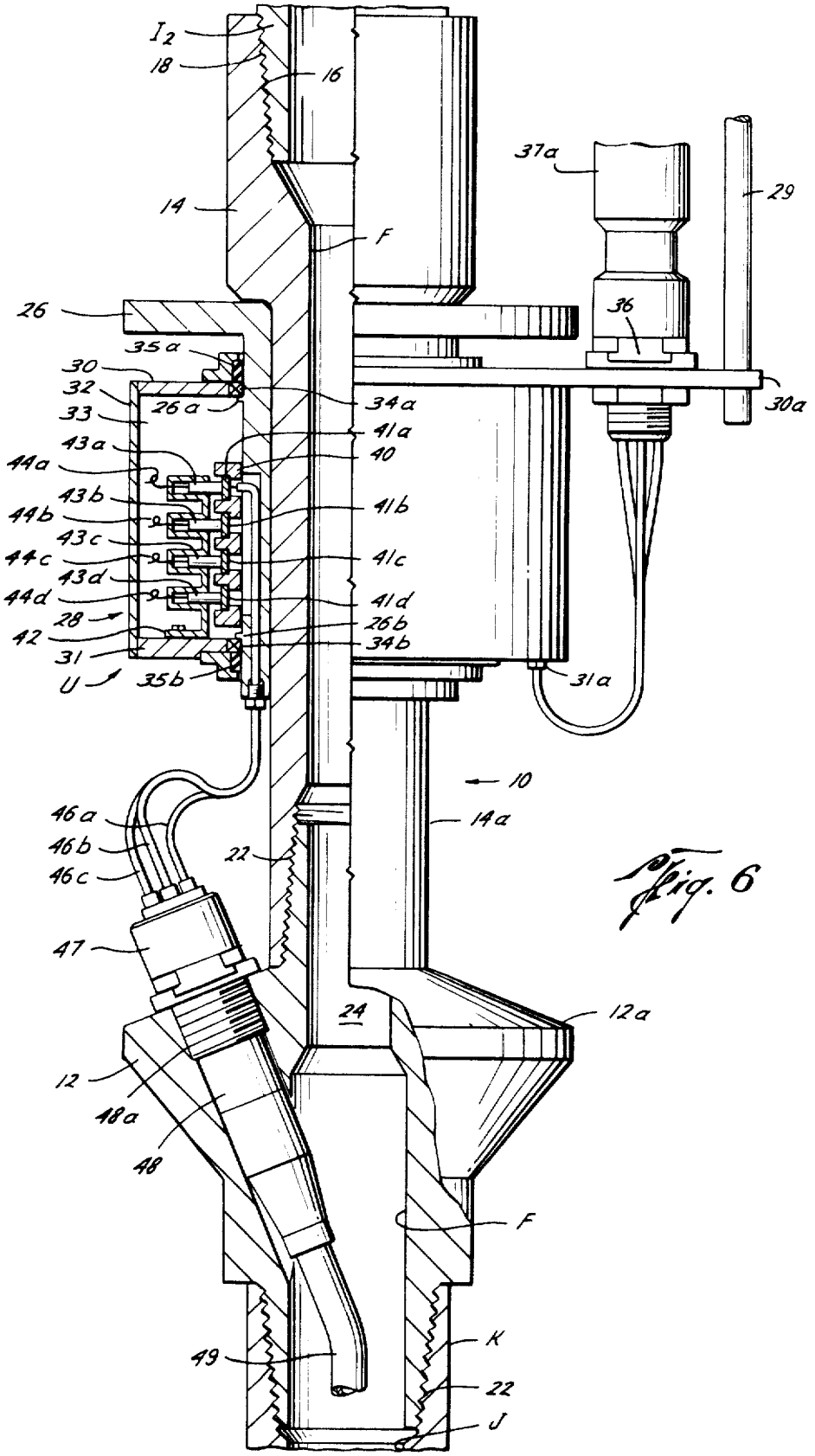
FIG. 6 is a side view, partially in section, of the electrical swivel of the present invention.

As illustrated in greater detail in FIG. 6, the electrical swivel unit U includes a tublular housing 10 forming a portion of and rotatable with the drilling string C. The housing 10 is preferably formed of a lower section 12 and an upper section 14 having upper box thread 16 for connection wih the downwardly extending pin threads 18 formed on the rotatable outlet nozzle I-2 of the fluid swivel D. The lower section 12 is provided with pin threads 20 for connecting with the drilling kelly box threads 22 in the usual manner. The section 12 and the upper section 14 are secured together by any suitable means, such as threaded engagement at 22.

The tubular housing 10 includes a longitudinally extending bore 24 formed therethrough for communicating the outlet nozzle I-2 of the drilling fluid swivel D wih a bore J of the kelly K for forming a portion of the bore F of the drilling string C to enable circulation of drilling fluid downwardly through the drilling string C from the drilling fluid swivel unit D.

Concentrically mounted about an exterior surface **14*a* of the upper section 14 and secured therewih is a rotating electrical contact support member 26. Concentrically mounted exteriorly of the support member 26 is an electrical contact housing casing 28 which is held against rotation with the member 26 by and upwardly extending support rod 29 which is secured at its upper end to the travelling block (not illustrated). The housing 28 is preferably formed by spaced parallel annular rings 30 and 31 connected at their outer edges with a tubular member 32 spaced from the stationary member 26 to form an enclosed or protected annular chamber 33. A pair of outwardly extending collars 26*a* and 26*b* of the stationary member 26 extends within the chamber 33 to support the housing 28 on the member 26 and blocks relative longitudinal movement therebetween. Upper and lower radial bearings 34*a* and 34 *b* are mounted on the annular plates 30 and 31, respectively, for enabling the circumferential rotational movement between the member 26 and the housing 28. Suitable packings 35*a* and 35*b* may be provided on the plates 30 and 31, respectively, to prevent undesired entry or leakage or moisture or other undesired fluid into the chamber 33 as is well known. The annular plate 30 is provided with an extension 30*a* which is secured to the support member 29 and which mounts an electrical plug 36. The plug 36 is connected through releasable engagement with a plug 37*a* of an electrical cable 37** connnected with the source S of electrical power in the usual manner.

Located in the chamber 33 and mounted with the rotating contact support member 26 is a member 40 formed of suitable electrical insulating material and mounting a plurality of spaced annular electrical contact rings **41*a*, 41*b*, 41*c* and 41*d*. Mounted with the fixed lower annular ring 31 is a brush support member 42 which carries in an electrically insulated manner a plurality of radially movable electrical contact brush members 43*a*, 43*b*, 43*c* and 43*d* for electrically contacting annular rings 41*a*, 41*b*, 41*c* and 41*d*, respectively, in the well known manner. Suitable biasing means for urging the brushes 43*a*, 43*b*, 43*c* and 43*d* into electrical contact and holding them in such relationship may be provided, but are not illustrated. Leading from each of the brushes is an electrical conductor line 44***a*, 44*b*, 44*c* and 44*d* which are preferably insulated as they extend through the sealed opening 31*a* of the lower annular plate 31 for connection with the plug 36 and the source S.

Preferably, but not necessarily, one of the annular contact rings 41*a*, 41*b* 41*c* or 41*d* is electrically connected to the drilling string C to serve as a neutral or ground electrical connection, as is well known in the art. Thus, in the illustrated embodiment, three of the annular contact rings are electrically connected by insulated wires which extend downwardly from the rotating support member 26 and which are designated 46*a*, 46*b* and 46*c* and which terminate in a releasable electrical connector plug 47.

The plug 47 releasably electrically connects with the plug 48 which extends through the walls of the lower housing section 12 on an outwardly extending collar 12*a* thereof. The collar 12*a* is also provided to protect cables 46*a*, 46*b* and 46*c* extending from the swivel unit U to the plug 47 from inadvertent snagging on obstructions in the derrick during drilling operations. The plug 48 is provided with threads at 48*a* for securing the plug 48 with the collar 12*a* and for effecting a fluid type seal therebetween to block leakage of fluid from the bore 24 of the housing 10 about the plug 48. A suitable electrical conductor line or means, such as flexible insulated cable 49 extends downwardly from the plug 48 in the bore F of the drilling string C to the upper end of the movable connector means V (FIG. 1A).

Figure 4A:
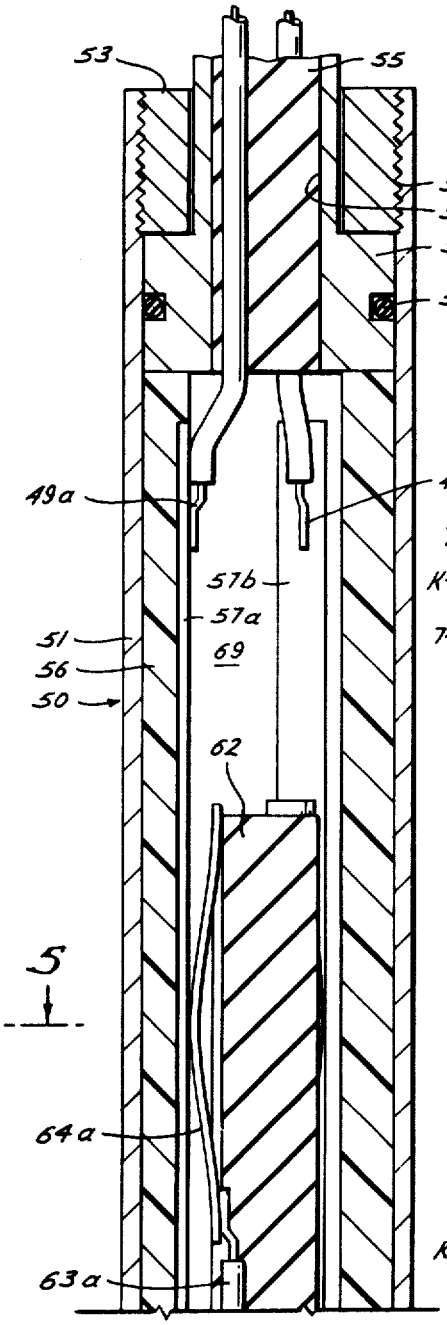
FIGS. 4A and 4B are side views, in section, and arranged in alphabetical sequence from top to bottom for illustrating in detail the movable connector provided to connect with the electrical conductors.
Figure 4B:
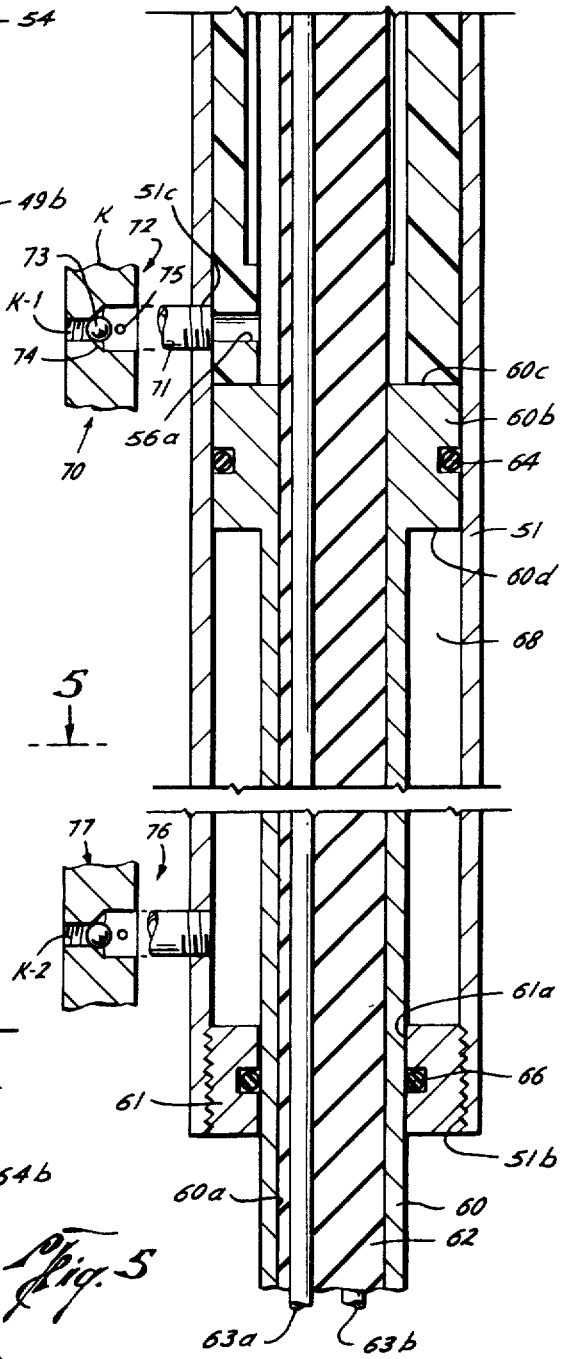

As illustrated in greater detail in FIG. 4A, the individual illustrated insulated electric wires 49*a* and 49*b* extend downwardly within a connector housing 50 which is secured in the bore J of the kelly K. The housing 50 is formed by a tubular means 51 having inner threads 51*a* adjacent the upper end of the sleeve 51 and inner threads 51*b* adjacent the lower end of the tubular sleeve 51 (FIG. 4B). An upper seal collar 52 is secured with the sleeve 51 by a threaded locking ring 53 which engages the threads 51*a*. The collar 52 carries an O-ring 54 for effecting a fluid type seal with the sleeve 51 to block leakage of fluid therebetween into the housing 50. The collar 52 provides a central opening 52*a* through which the wires 49*a* and 49*b* extend into the housing 50. After the wires 49*a* and 49 *b* are properly connected in the housing, as will be set forth in greater detail hereinafter, the central opening 52*a* is preferably filled with a flowable castable material, such as any rigid insulating plastic material, which cools to cast in place 55 to form a fluid type seal for the central opening 52*a*. Concentrically disposed adjacent the sleeve 51 and below the collar 52 is a body of electrical insulating material 56 mounting a plurality of downwardly extending electrical contact strips 57*a*, 57*b* and 57*c* and which is insertable into the tubular member 51 adjacent threads 51*a*. Each of the contact strips 57*a*, 57*b* and 57*c* are electrically connected with one of the wires of the line 49 extending into the housing adjacent the upper ends of the contact strips 57*a*, 57*b* and 57*c* as illustrated with 49*a* and 49*b*.

The housing 50 mounts a connector member 60 which is longitudinally movable relative to the housing to and from a first or upper electrically disconnected position and a second or lower electrically connected position for effecting electrical contact with the electrical conductor system Y in the bore F of the drilling string C below the kelly K. The connector member 60 is concentrically mounted with the sleeve 51 and extends downwardly from the housing 50 through a central opening 61*a* of a lower locking ring 61 which engages threads 51*b* of the sleeve 51. The lower locking ring 61 carries an O-ring 66 for effecting a fluid tight annular sliding seal with the connector member 60 to block leakage of fluid therebetween as the connector member 60 is move longitudinal. Preferably, the connector member 60 provides a central opening 60*a* having a body of rigid cast electrical insulating material 62 disposed therein through which a plurality of electrically conductive wires 63*a*, 63*b* and 63*c* extend. The upwardly extending insulation material 62 forms a portion of the connector member 60 and seals the central opening 60*a* against passage or leakage of fluid.

Figure 5:
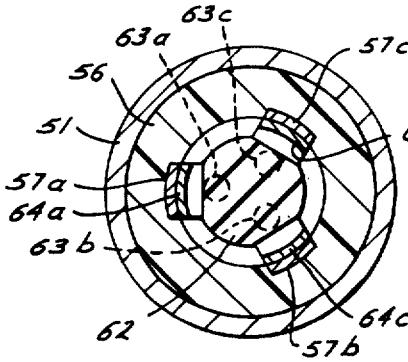
FIG. 5 is a view taken along line 5—5 of FIG. 4A.

Referring now to FIGS. 4A and 5 the electrically insulated portion 62 of the connector member 60 mounts a plurality of radially outwardly extending resilient electrical contacts 64*a*, 64*b* and 64*c* which ride along the fixed contacts 57*a*, 57*b* and 57*c*, respectively for electrically connecting therebetween while enabling longitudinal movement of the connector member 60 relative to the housing 50. Suitable anti-rotation means (not illustrated) are provided with the connector means 60 to prevent relative circumferential rotation with respect to the housing 50 in order that the contacts 64*a*, 64*b* and 64*c* remain in alignment for electrical contact with the strips 57*a*, 57*b* and 57*c*, respectively during such longitudinal movement of the connector member 60. The contacts 64*a*, 64*b* and 64*c* are preferably of the bow spring type which extend radially outwardly for riding along the strips 57*a*, 57*b* and 57*c* with the flexible contacts deforming sufficiently to maintain electrical contact with the strips. Each of the circumferentially spaced bow spring contacts 64*a*, 64*b* and 64*c* are connected electrically to downwardly extending conductors 63*a*, 63*b* and 63*c*, respectively carried by the connector member 60.

The connector system X also includes means for effecting the desired longitudinal movement of the connector member 60. In the preferred embodiment, the connector member 60 forms a collar 60*b* (FIG. 4B) for providing an upwardly facing annular shoulder 60*c* and a downwardly facing annular shoulder 60*d*. An O-ring 64 is carried on the collar 60*b* for effecting an annular fluid type sliding seal with the tubular member 51 to block leakage of fluid between the collar 60*b* and the tubular member 51. The seal effected by the O-ring 64 and the O-ring 66 carried by the lower locking ring 61 define an annular expansible chamber 68 formed by the connector member 60 and the housing 50. Fluid pressure in the expansible chamber 68 will urge on the downwardly facing annular shoulder 60*d* for urging upward movement of the connector member 60 to the first or upper position within the kelly K for disconnecting from the electrical conductor system. The O-ring 64 and the O-ring 54 carried by upper sleeve 52 define a second or upper expansible chamber for urging downwardly on the upwardly facing annular shoulder 60*c* and the insulating material 62 to urge the connector member 60 to move downwardly to the lower or second position for connecting with the electrical conductor system Y. Of course other means for effecting desired movement of the connection member 60, such as, but not limited to, springs or weights, will be apparent to those skilled in the art.

Fluid pressure is communicated to and from the upper expansible chamber 69 as desired from exteriorly of the kelly K through a flow port means 70. As illustrated in FIG. 4B, the port means 70 includes a connector nipple 71 which is threadedly secured to the sleeve 51 in flow communication with a port 51*c* formed through the tubular member 51. The insulating material 56 is also provided with a port 56*a* in flow communication with the port 51*c* to permit ingress and egress of control fluid from the chamber 69. The nipple 71 extends outwardly from the housing 50 for securing with the kelly K in flow communicating relationship with an opening K1 through the kelly K.

As illustrated schematically, a valve means 72 is employed to control communication of fluid pressure to and from the upper chamber 69. The schematically illustrated valve means 72 includes a spherical or ball member 73 which seats on an annular seating ring 74 to serve as a check valve for blocking flow of control fluid from the chamber 69. When the ball 73 is displaced from the seat 74 flow may be either into or out of the chamber 69 as desired. A suitable retainer means 75 is employed to maintain the ball 73 in proximity to the shoulder 74 when flow is into the chamber 69. When the source of control fluid pressure is made up in any well known desired manner to the opening K1 for introducing or removing control fluid pressure from the chamber 69, a mechanical extension on the connector nozzle displaces the ball 73 from seating engagement with shoulder 74 and insures spacing from the shoulder 74 as long as the source of control fluid pressure is connected at K1. Such valving systems are well known to those skilled in the art and many other systems for controlling the fluid pressure in the chamber 69 will be readily apparent to those skilled in the art.

The first or lower chamber 68 is also provided with a port means 76 and valve means 77 which are illustrated and operated in the identical manner. It should be noted, however, that the connections must be made with both the openings K1 and K2 to prevent blockage of fluid by the valve means 72 or 77 in the chambers 69 and 68, respectively, when the connector member 60 is being moved.

Mounted on the lower end of the movable connector member 60 is a female electrical connector plug means 80 (FIG. 1A) which engages an uppermost male connector plug means 82 of the electrical conductor system Y for establishing desired electrical contact therebetween. It will be readily apparent to those skilled in the art that the position of the male and female connector plugs may be reversed without departing from the scope of the present invention. Bow spring 84 and 86 extend radially outwardly from the plug means 80 and 82, respectively, to serve as centralizers for aligning the plugs 80 and 82 when moving the plug means 80 downwardly into electrical contact establishing engagement with the plug means 82. The upper plug means 82 of the electrical conductor system y is supported in the bore F of the drilling string C against downward movement to ensure engagement with the plug means 80 for establishing electrical contact as will be set forth in greater detail hereinafter.

The electrical conductor system y serves to transmit the electrical power from the plug 82 to the electric motor M through the bore F for effecting rotation of the drill bit B. As the length of the drilling string between the kelly K and the drill bit B is increased by adding joints of drilling pipe to the drilling string C as the drill bit B moves deeper into the formation Z in making the borehole W, the electrical conduit system Y must also provide for increasing the length of the electrical conductor system Y in a manner to be set forth in greater detail hereinafter. The length of the electrical conductor system Y will of course be controlled by the length of the drilling string C and must be compatible therewith.

Referring now to FIGS. 2A and 2B, there is illustrated in greater detail a connector plug means, generally designated 100, of the electrical conductor system Y of the present invention. The electrical connector plug apparatus 100 preferably includes a lower male connector plug means 102 which releasably electrically connects with an upper female connector plug means 104, but as previously mentioned the relative positions of the male and female connectors may be reversed.

The lower plug means 102 includes an upper tubular member 106 and a lower tubular section 108 secured together by suitable means such as threaded engagement at 107 to form the plug body. The upper tubular body 106 forms an upwardly facing annular landing shoulder 106*a* and having a threaded outer surface 106*b* located below the shoulder 106*a* for connectiion with a fishing tool to enable release of the lower plug means 102 when desired. Disposed in a central opening or bore 106*c* of the tubular member 106 is an upwardly extending body of electrical insulating material 110. The insulating material 110 extends upwardly past the shoulder 106*a* for forming the male connector carrying a plurality of three spaced annular electrical contacts 112*a*, 112*b* and 112*c* on its outer surface 110*a*. The spaced annular contacts 112*a*, 112*b* and 112*c* are electrically connected to the upper ends of the electrical conductors 114*a*, 114 *b* and 114*c* which extend downwardly from the plug means 102 in a surrounding insulating jacket 115, and which will be referred to hereinafter as conductor 116.

The plug means 102 is releasably secured in the bore F of the drilling string C to support the downwardly extending connector 116. It will be understood that the isulation jacket 116 and conductors 114*a*, 114*b* and 114*c* may be flexible, such as a standard insulated cable, or it may be substantially rigid jacket 116 without departing from the scope of the present invention. As best illustrated in FIG. 3, the insulation jacket 116 may be provided with an armored sheath 116*a*.

In the illustrated embodiment of FIGS. 2A and 2B, a drilling conduit joint or sub 120 is made up in the drilling string C using the lower pin threads 121 (FIG. 2B) to threadedly engage the box threads 122 for connecting the sub 120 in the drilling string in the desired location. The drilling sub 120 includes a central longitudinally extending flow passage defined by an inner surface 120*a* for enabling circulation of drilling fuid downwardly through the bore F of the drilling string C in the usual manner. The sub 120 is provided with a plurality of longitudinal spaced annular recesses 120*b*, 120*c* and 120*d* along the surface 120*a* for releasably supporting the lower plug means 102 in the bore F of the drilling string C. A plurality of movable dogs 124 are pivotally connected to the lower tubular body 108 by pivot pin 108*a* at a first end 124*a* and the other or free end of the dogs 124*b* are thus movable to and from a released position adjacent the insulation jacket 116 and a securing or radially extended position where the free end portion 124*b* fits within one of the plurality of recesses 120*b*, 120*c* or 120*d* for securing the plug means 102 in the bore F of the drilling string C. In the locking positions the dogs 124 engage a downwardly facing annular shoulder surface 108*b* formed by the lower body member 108 to prevent a downward movement of the plug means 102. Upward movement of the body 108 will of course enable the free ends 124*b* of the dogs to move radially inwardly from the recesses 120*b*, 120*c* or 120*d* to effect release of the plug means 102 from securing engagement with well conduit C.

The upper female connector plug means 104 inludes a body 130 formed of electrical insulating material and having upwardly extending cavity 130*a* for receiving in a close fitting fluid excluding relationship the tapered male connector 110 carrying spaced annular contacts 112*a*, 112 *b* and 112*c*. Disposed in the cavity 130*a* is corresponding spaced relationship are a plurality of electrical contact rings or members 132*a*, 132*b* and 132*c* which establish electrical contact with the annular contacts 112*a*, 112*b*, 112*c*, respectively, when the plug means 104 is connected with the plug means 102. Reference is specifically made to U.S. Pat. No. 3,378,811 for incorporating by reference herein a more complete disclosure of the desirable structure, features, characteristics, function and operation of the electrical conductor assembly 100.

The body 130 carries O-rings 134 and 135 for effecting spaced annular seals between the body 110 and the walls of the cavity 130*a* to block entry or leakage of drilling fluids into the cavity 130*a* when the plug means 102 and 104 are mated or engaged which could possible interrupt the desired electrical contact. A port 136 is formed in the body 130 for enabling escape of drilling fluids from the cavity 130*a* as the plug means 102 and 104 move into electrical engagement.

The upper plug body 130 carries a plurality of electrical conduits 138*a*, 138*b* and 138*c* which are electrically connected with the rings 132*a*, 132*b* and 132*c*, respectively, and which extend upwardly from the plug means 104 for supplying electrical power to the spaced contacts 112*a*, 112*b* and 112*c* of the plug means 104 through the conductor designated 139 and which may be identical to downwardly extending conductor 116. Suitable weights or sinker bars 140 may be mounted above the female plug body 130 to ensure movement of the plug body 130 longitudinally down the bore F of the drilling string C with sufficient force to fully engage the lower plug means 102. A plurality of radially extending bow springs partially illustrated at 142*a* and 142*b*, are carried by the plug body 130 for aligning the cavity 130*a* with the upwardly extending portion 110 of the lower plug means 102. The bow springs 142*a* and 142*b* resiliently engage the drilling conduit C and the wall 120*a* to maintain the cavity 130*a* centered in the bore F as is well known in the art.

Also mounted with the plug 130 are a plurality of downwardly extending flexible latch members 144 having inwardly projecting latching dogs 144*a* mounted on lower end. The inwardly facing surfaces 144*b* of the latch dogs 144*a* engage lugs 106*x* of the tubular member 106 adjacent the shoulder 106*a* for latching or securing engagement therewith when the upper plug means 104 is in proper electrical contact establishing engagement with the lower plug means 102. The dogs 144*a* prevent or block inadvertent disengagement of the desired electrical connection, but may be released by sufficient upward force exerted on the plug body 130 by the conductor 139 which flexes the arms 144 radially outwardly to free the dogs 144*a* sufficiently from the surface 106*a* to enable separation of the electrical connection.

Referring now to FIGS. 1B and 1C, the connector plug means previously described in greater detail in FIGS. 2A and 2B is illustrated as being located in FIG. 1C. A similar connector plug means having like reference characters increased by 100 for referencing like parts is illustrated in FIG. 1B with the conductor 139 extending downwardly from an upper plug connector means 206 thereof and terminating at the connector plug means 130 for providing a length of conductor 139 that may be lowered down the bore F of the drilling string C for connecting at its lower end with a mating connector plug means 102 at a downhole location in the drilling string C in the preferred embodiment. The preferred distance of the conductor 116 between the electric motor M and the releasably secured plug body 106 in the bore of the drilling string C is approximately 5000 feet. Also the preferred distance of the conductor 139 between the releasably secured conductor plug body 206 and the plug 130 is also 5000 feet. Of course, it will be readily apparent to those skilled in the art that from the present invention other lengths of conductor cable may be employed as desired.

As the drilling bit B moves deeper into the formation Z, when forming the borehole W, additional joints of drilling pipe are added to the drilling string C immediately before the kelly K in order to ensure that the kelly is engaged by the rotary table R. Normally each added joint of drilling pipe is approximately 30 feet in length, but often two or even three joints of drilling pipe are added in the drilling string C at any one time. The particular length of the added section of drilling pipe, whether 30 feet, 60 feet, 90 feet or another length, is not of critical significance as the electrical conductor system Y of the present invention provides means for electrically conducting in a desired manner through any number of added joints of any length.

Figure 7:
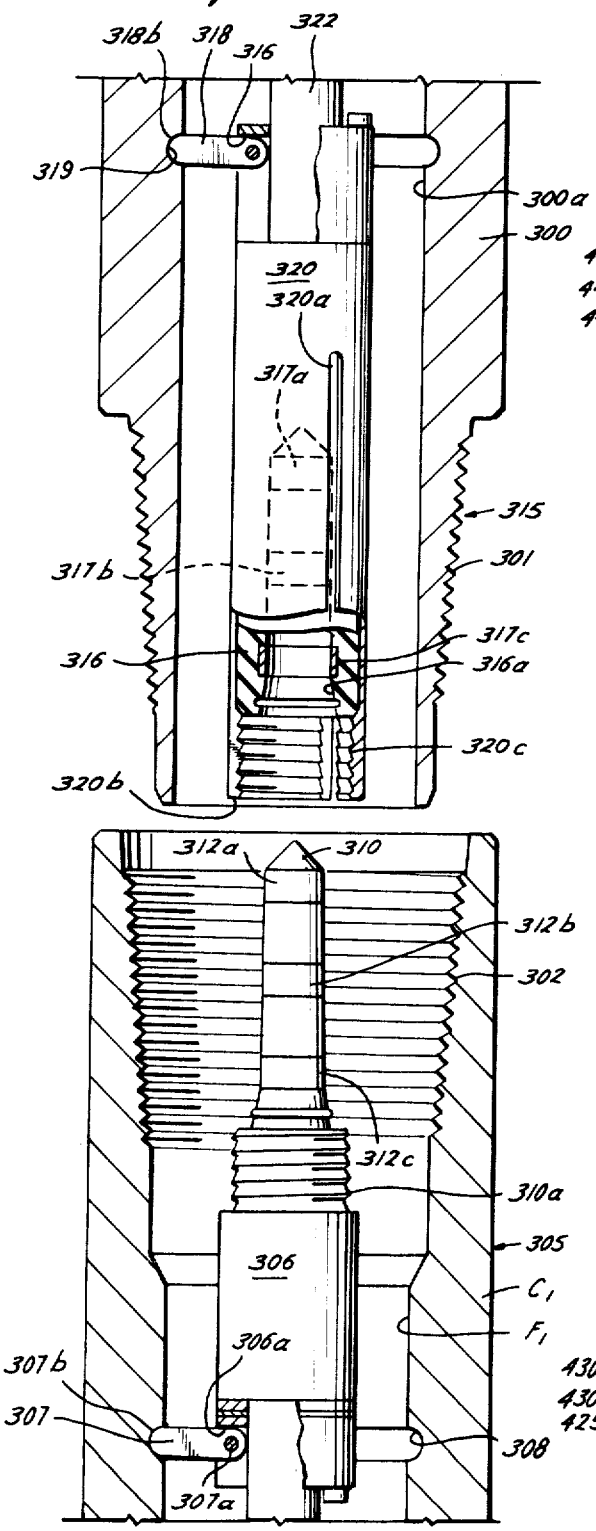
FIG. 7 is a side view, in section, of another embodiment of an electrical connector apparatus of the present invention.

An embodiment of the electrial connector apparatus Y of the present invention is illustrated in FIG. 7 which is arranged to be connected or made up substantially simultaneous with the connection or makeup of the added joint 300 of drill pipe in the drilling string C1. The additional joint of drill pipe 300 is provided with pin threads 301 at its lower end which threadedly engage the box threads 302 of the drilling string C1 for connecting the joint 300 in the drilling string C in the normal manner by rotating the joint 300 while the drill string C1 is secured from rotation to effect the threaded engagement. As such, the embodiment of FIG. 7 is particularly well suited for use with the joints to be added to lengthen the drilling string C.

Releasably secured in the bore F of the drilling string C adjacent the box threads 302 is a connector plug means, generally designated 305, including a body 306 having a plurality of latch dogs 307 pivotally connected thereto adjacent connected ends 307*a* of the latch dogs 307. Each of the latch dogs 307 provide an end 307*b* which is movable to and from a free or released position to a radially outwardly extending locking position for engaging an annular recess 308 formed in the inner surface 309 of the wall conduit C1. The plug body 306 forms a downwardly facing annular shoulder 306*a* which bears on the latch dogs 307*b* in the locking or securing position to releasably secure the plug body 306 in the bore F1 of the drilling string C adjacent the threads 302. Upward movement of the plug 306 will enable the free end 307*b* of the latch dogs 307 to move out of the recess 308 for releasing the plug 306 from the secured position and enabling movement of the plug means 305 through the bore F1 of the drilling string C. Extending upwardly from the plug body 306 is a male connector 310 carrying the spaced annular contact rings 312*a*, 312*b* and 312*c* in a similar manner to that of the embodiment described in FIG. 2A. Located on the male member 310 below the contact ring 312*c* and above the plug body 306 is a threaded surface 310*a* having the same thread pitch as that of the box and pin threads 301 and 302.

Releasably secured in the joint 300 to be added adjacent the threads 301 is a lower female connector plug means, generally designated 315 which is engaged in electrical contact with the lower plug means 305 when the joint 300 is connected in the drilling string C1 to form a portion thereof. The female plug means 315 includes a plug body 316 having a central cavity 316*a* for receiving in close fitting relationship the tapered male connector 310. Disposed in the cavity 316*a* are the spaced annular contact rings 317*a*, 317*b* and 317*c* for effecting electrical contacts with the rings 312*a*, 312*b* and 312*c*, respectively, when the joint 300 is threadedly connected in the drilling string C1.

The lower plug means 315 is provided with a plurality of latch dogs 318 for releasably securing the lower plug means 315 in the joint 300 adjacent the pin threads 301 for making up with the plug means 305. The latch dogs 318 are pivotally connected to the upper plug means 315 in a manner similar to that of the connection of the plurality of latch dogs 307 with the lower plug means 305. Each of the latch dogs 318 have a free end 318*b* which are received and secured in an annular recess 319 formed in the inner surface 300*a* of the joint 300. In the radially expanded locking position the dogs 318 engage an annular shoulder 316*a* formed by the plug body 316 to block downward movement of the lower plug means 315 relative to the recess 319 for releasably supporting the lower plug means 315 while enabling limited upward movement of the plug means 315 without releasing the latch dogs 318 from the recess 319.

Concentrically mounted about the body 316 and secured therewith adjacent the connection of the plurality of dogs 318 is a tubular sleeve 320 having a plurality of longitudinal slots 320*a* formed therein which extend downwardly to enable radial expansion of the lower end 302*b* of the sleeve 320. The sleeve 320 has a threaded inner surface 320*c* below the cavity 316*a* which is adapted to threadedly engage the threads 310*a* of the lower plug means 305 when the threads 301 are made up with the threads 302. The sleeve 320 will radially expand adjacent threads 320*c* to enable engagement of the threads 320*c* and 310*a* for securing the plug means 315 with the plug 305 when the joint 300 is made up in the drilling string C. The threads 310*a* are also adapted to be engaged by a fishing tool when desired for securing with the tool for enabling release of the lower plug means 306 by releasing latch dogs 307 when the fishing tool moves upwardly.

Extending upwardly from the conductor plug means 315 is electrical conductor line 322 which extends upwardly in the joint or joints to be added to an upper connector plug means (not illustrated) such as that disclosed in the lower half of FIG. 7. Thus, the drilling string C may be lengthened as desired by adding an additional joint or joints of drilling pipe without special tools or apparatus or additional operations to connect the electrical connector plugs 305 and 315. It should also be noted that the electrical conductor 322 may be either a flexible insulated cable or a rigid type insulating member carrying the electrical conductors.

Figure 8:
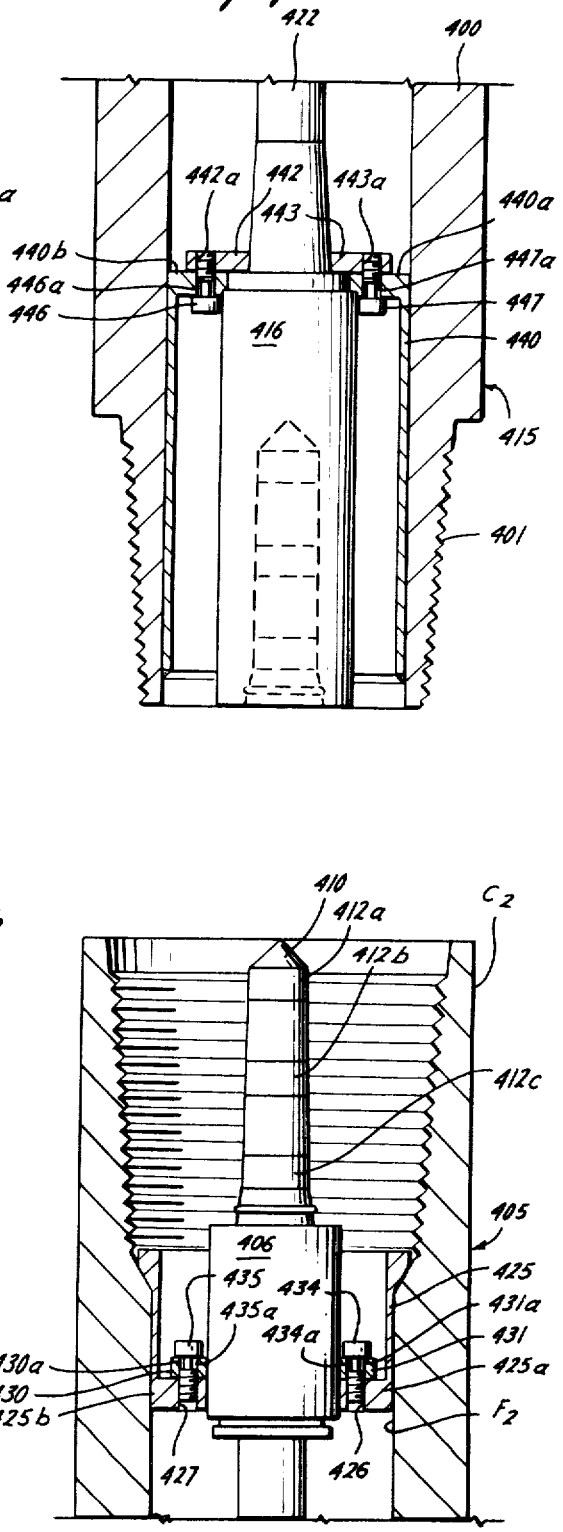
FIG. 8 is a view similar to FIG. 7 of a third embodiment of an electrical connector apparatus of the present invention.

Another embodiment of the electrical connector apparatus also adapted to be made up as a joint or joints of drilling pipe are added is illustrated in FIG. 8. In this embodiment, the pipe joint 400 to be added includes pin threads 401 which serve to releasably secure the joint 400 with the drilling string C2 and to releasably secure and align an upper connector plug means 415 carried by the joint 400 for electrical contact engagement with a lower plug means 405 as the joint 400 is made up in the drilling string C2. The lower plug means 45 includes a plug body 406 having an upwardly projecting male connector 410 carrying the spaced annular electrical contact rings 412*a*, 412*b* and 412*c* in the manner previously set forth hereinabove.

The lower plug means or apparatus 405 includes a tubular bracket 425 which is secured with the drilling string C2 by a suitable means, such as, but not limited to, welding. The bracket 425 includes a plurality of two inwardly projecting plugs or fingers 425*a* and 425*b* having threaded openings 426 and 427, respectively, formed therethrough. Extending outwardly from the plug body 406 are projection or ears 430 and 431 having openings 403*a* and 431*a*, respectively, formed therethrough which align with the openings 426 and 427. The threaded openings 426 and 427 receive bolts 434 and 435, respectively, for securing the lugs 430 and 431 with the bracket 425. The bolts 435 and 436 are provided with neckdown portions 434*a* and 435*a* in the opening 430*a* and 431*a*, respectively, to predetermine the force at which the bolts 435 and 436 will break to release the plug means 405 when an upward force is imparted to the plug body 406 by a fishing tool.

The upper plug means 415 includes a tubular bracket 440 having inwardly projecting ears or lugs 440*a* and 440*b*. Outwardly projecting lugs or ears 442 and 443 mounted on the upper plug body 416 provide threaded openings 442*a* and 443*a* for receiving bolts 446 and 447, respectively. The bolts 446 and 447 are also provided with neckdown portions 446*a* and 447*a* for predetermining the tensile force required for release by an upward pull exerted on the plug 416 by a fishing tool pulling on the upper end of the upwardly extending conductor line 422. By use of inwardly projecting fingers 425*a*, 425*b*, 440*a* and 440*b* drilling fluid is enabled to be circulated down the bore F to the drilling string C2 in the usual manner when the plug means 405 and 415 are operably connected in the bore F2 of the drilling string C2.

Figure 9:
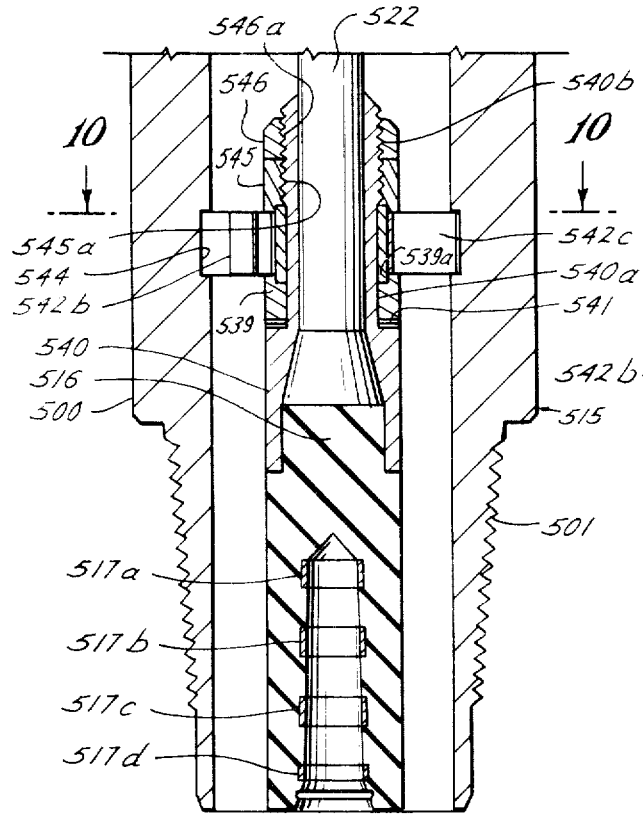
FIG. 9 is a view similar to FIGS. 7 and 8 of a fourth embodiment of an electrical connector apparatus of the present invention.
Figure 10:
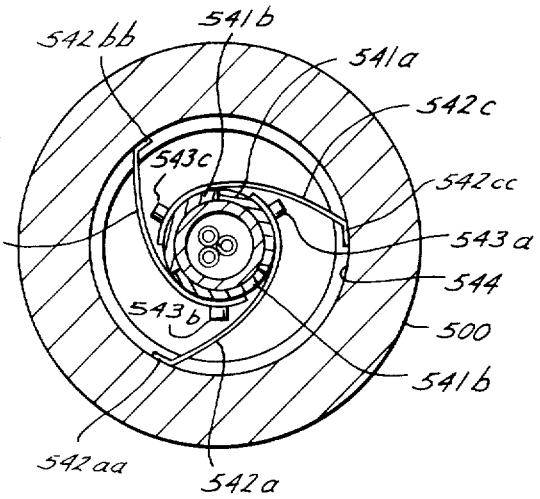
FIG. 10 is a cross section taken along line 10—10 in FIG. 9.
Figure 10:
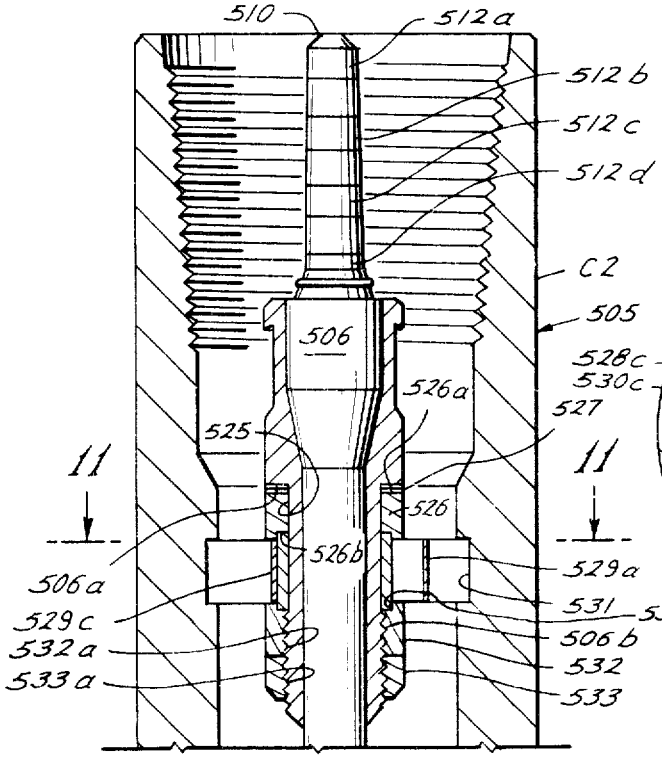
Figure 11:
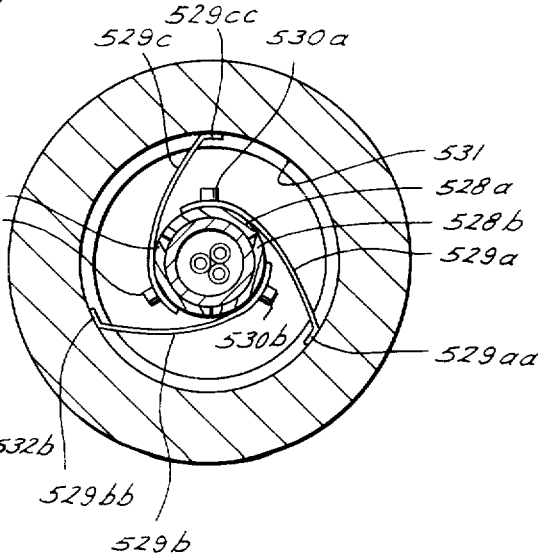
FIG. 11 is a cross section taken along line 11-11 in FIG. 9.

Another embodiment of the electrical connector apparatus also adapted to be made up as a joint or joints of drilling pipe are added is illustrated in FIGS. 9–11. The reference numerals of this embodiment which designate common components with the embodiments of FIGS. 7 and 8 and have reference numerals beginning with 500 corresponding to the comparable reference numerals beginning with 300 and 400 of FIGS. 7 and 8, respectively. In this embodiment, the pipe joint 500 to be added has pin threads 501 which serve to releasably secure the joint 500 with the drilling string C2 and to releasably secure and align an upper collector plug means 515 carried by the joint 500 for electrical contact engagement with a lower plug means 505 as the joint 500 is made up in the drilling string C2. The lower plug means 505 includes a plug body 506 having an upwardly projecting male connector 510 carrying the spaced annular electrical contact rings 512*a*, 512*b*, 512*c* and 512*d* in the manner previously set forth hereinabove.

The lower plug means or apparatus 505 includes a stepped portion 525 upon which is slidable mounted an anchor retaining ring 526. The lower female connector carries the spaced annular electrical contact rings 517*a*, 517*b*, 517*c* and 517*d* which are adapted to engage with spaced annular contact rings 512*a*, 512*b*, 512*c* and 512*d* formed in electrical connection. The relative position of the anchor retaining ring on the plug body 506 is determined by the number of adjusting shims 527 placed between the surface 526*a* of the anchor retaining ring and the surface 506*a* of the plug body. As will be apparent from the discussion below, the number of shims may be added or subtracted to longitudinally change the relative position of the connector plug 510 to the drill string C2 to properly position the contact rings 512*a*, 512*b*, 512*c* and 512*d* to the corresponding contacts in the female connector plug 516. As best shown in FIG. 11, a plurality of anchor ring segments 528*a*, 528*b* and 528*c* form a tubular member surrounding the plug body and retained in a notch 526*b* in the anchor retaining ring. Mounted on each anchor segment are anchor flutes 529*a*, 529*b* and 529*c*. The anchor flutes are made of resilient spring material and are mounted to the anchor ring segments by cap screws 530*a*, 530*b*, 530*c* which are screwed into the anchor ring segments. At the ends of the spring anchor flutes are circumferential tip portions 529*aa*, 529*bb* and 529*cc* which fit into a groove 531 in the inner passageway of the drill string. The non-biased position of each anchor flute will be greater than the diameter of the groove 531 so that the end segments 529*aa*, 529*bb* and 529*cc* are tightly held in the groove. However, an upward force applied to the plug means by a fishing tool will cause the anchor flutes to bias inwardly enough to release them from the groove and hence release the plug means from the drill string. An anchor retaining nut 532 retains the anchor ring segments with the plug body by notch portion 532*b* and threads 532*a* threadably engaging threads 506*b* on the plug body. An anchor lock nut 533 having threads 533*a* also engages the threads 506*b* on the plug body when mounted thereon to ensure that the anchor retaining nut 532 does not loosen.

The upper plug means 515 includes a socket sleeve 540 which forms a part of the upper plug body 516. As with the lower plug means a plurality of shims 541 are provided to adjust anchor flutes on the upper plug means. A retaining ring 539 slips over the stepped down portion 540*a* of the assembly. The plurality of anchor retaining rings 541*a*, 541*b* and 541*c* (FIG. 10) surround the stepped down portion 540*a* of the socket sleeve assembly and are retained by notch 539*a* of the retaining ring. A plurality of anchor flutes 542*a*, 542*b* and 542*c* are connected to the locking segments by cap screws 543*a*, 543*b* and 543*c*. Th circumferential tip portions 542*aa*, 542*bb* and 542*cc* on the anchor flutes engage a groove 544 in the joint 500. Threaded anchor retaining nut 545 having threads 545*a* are threaded on threads 540*b* of the socket sleeve to retain the anchor flute assembly in position. An anchor lock nut 546 having threads 546*a* is provided to lock the anchor retaining nut 545 in position. The anchor flutes 542*a*, 542*b* and 542*c* are made of spring material as is the lower plug assembly and will release from the groove 544 by an upward pull exerted on the plug 516 by a fishing tool pulling on the upper end of the upwardly extending conductor line 522. As shown in FIGS. 10 and 11, the annulus between the conductor line assembly and the drill pipe has a minimum reduction of cross sectional area due to the design of the anchor flutes. This minimum of interference of the flow passage by the anchor flutes facilitates the flow of drilling mud through the drilling string in the usual manner when the plug means 505 and 515 are operably connected in the bore of the drilling string.

Operation of the Present Invention

The present invention is preferably employed when the borehole W is approximately 10,000 feet in depth or greater. At the borehole W depth it is desired to commence using the deep drilling method and apparatus of the present invention, the normal rotary drilling operations are terminated and the drilling string C removed from the hole. At the surface G, the drill bit B is connected to the electrical motor M. Also, various instrumentation subs may be connected in the drilling string C as desired. The electrical motor means M is provided with an upwardly extending male connector plug similar to that illustrated in FIGS. 2A which is adapted to receive a female connector plug lowered down the bore F of the drilling string C. At this time, the electrical swivel unit U may be connected between the drilling fluid swivel D and the kelly K having the movable connector means V therein is connected below the electrical swivel unit U.

The drill bit B and motor M are then lowered down the borehole W by adding the desired number of drill collars and standard drill pipe joints to a desired depth preferably of slightly less than 5,000 feet. When the drilling string is 2 to 8 feet short of the 5,000 foot distance above the electrical connector plug of the electrical motor, the sub 120 is connected in the drilling string C.

A 5,000 foot length of flexible cable 110 having a lower connector plug, such as illustrated in FIG. 2A, is then lowered down the bore F of the drilling string C for effecting electrical connection with the upwardly extending male plug electrically connected to the motor means M.

After checking electrical continuity of the electrical cable 116 to the motor means M, the latch dogs 124 are set in the appropriate recess 120*c* for releasably supporting the conductor 116 in the bore F of the casing C. The flexible cable 116 should be supported in such a manner that the cable is provided with sufficient slack to ensure a proper electrical connection, but sufficiently tight to prevent the cable 116 from coiling at any point in the bore F to block the flow of drilling fluid down the bore F of the well conduit C.

After securing the lower connector plug body means 106 in the sub 120, additional joints of drill pipe are added to the drilling string C above the sub 120. When the length of the drill string C above the lower plug body means 106 is 2 to 8 feet short of the preferred length of 5,000 feet, a second sub 220 which is substantially identical to the sub 120 is connected in the drilling string C to form a portion thereof. A second 5,000 foot length of flexible cable 139 is then lowered down the bore of the drilling string in order that the lower female connector plug means 104 of that cable 139 will engage and electrically connect with the male connector plug means 102 secured in the sub 120.

As will be obvious to those skilled in the art, additional lengths of flexible cable may be installed in the drilling string using the subs in the releasable connector plugs for securing in the subs. It will also be obvious to those of ordinary skill in the art that any desirable cable length may be employed, but preferably increments of 5,000 feet and 1,000 feet are employed. After effecting the lower connection of each added cable length, electrical continuity to the motor means M is checked prior to releasably securing the upper plug means of a cable in the appropriate sub.

After continuity from the plug 206 to the motor M is confirmed, the kelly K may be connected to the upper end of the sub 220. Control fluid pressure is then supplied to chamber 69 while exhausting annular chamber 68 for moving the female connector plug 80 downwardly to engage the plug 202 for effecting electrical continuity between the source S of controlled electrical power and the motor means M. Electrical power may then be supplied to the motor means M in a controlled manner for rotating the drill bit B to conduct drilling operations. During such drilling operations, drilling fluid is normally circulated down the bore F of the drilling string C and out through the ports B of the drill bit B as is well known in the art. In addition, the rotary table R may be employed to rotate the drilling string C while the motor means is rotating the drill bit B to prevent sticking of the drilling string C in the borehole W.

As the drill bit B moves deeper into the formation Z, additional joints of drill pipe must be added to maintain the drill bit B at the bottom of the borehole W. As illustrated in FIGS. 1A and 1B a number of substantially rigid and self supporting connector elements 90 and 91 having compatible connector rings may be lowered down the bore of the added joints after they are connected in the drilling string for electrically conducting between the plug 80 and the plug body 206.

Alternately, the added joints of drilling pipe may have releasably secured therein electrical conductors in the manner illustrated in FIGS. 7–11. In these embodiments the electrical conductor is made up with the plug means 202 when the additional joints are added to the sub 220. Obviously this electrical connection would also be effected with the upper plug of each added joint or sections of joints as additional joints or sections of joints are added thereabove. The movable connector plug 80 would of course move to electrically contact with the uppermost plug releasably secured in the bore F of the drilling string C and for compensating for minor variations and differences of length of the conductor means Y in the drilling string C.

Should it become desirable to run a tool through the bore F of the drilling string C for any reason, the electrical conductor system Y may be removed from the bore F of the drilling string C to enable passage of the well tool through the bore F. This is accomplished by disconnecting the plug 80 from the plug 82 by introducing fluid pressure into the lower annular chamber 68 while venting the upper chamber 69 to enable the connector plug to move upwardly into the kelly K. The kelly K is then rotated to disconnect from the drilling string C. A lifting mechanism of the derrick may then be connected to the upper plug 82 of the rigid connector member 91 which threadedly engages the lower rigid connector 90 by threaded engagement at 92. The lifting force imported to the plug 82 will effect separation of the lower female plug 230 from the plug 206 for enabling removal of the connectors 90 and 91 of the bore F of the drilling string C. Suitable fishing tools mounted on the lower end of a wireline may be employed to retrieve the releasable conductor embodiments of FIGS. 7 and 8 when those embodiments are used with an added joint or section of joints of drilling pipe in a manner similar to that employed for the conductor 139.

To remove the flexible conductor 139 a fishing tool is lowered on a wireline down the bore F of the drilling string C for connection with the threads **206*b* of the plug 206. After connecting with the plug 206 an upward pull is exerted on the wireline to move the plug 206 upwardly for releasing the free ends 224*b* of the plurality of latch dogs 224 from the recess 220*b* of the sub 220 and for moving the conductor 139 upwardly. As the conductor 139 is pulled upwardly the lower plug means 104 of the conductor 139 is disconnected from the upper plug means 102 of the lower connector 116 by radial expansion of the latching sleeve 144. After removing the cable 139 from the bore F of the drilling string C the fishing tool may again be lowered to engage the threads 106*b* of the plug means 102 for recovering the lower conductor 116** from the bore F of the drilling string C in a similar manner.

While the disclosure hereinabove has been directed to transmission of electrical power to the downhole drilling motor M, it will be immediately apparent to those skilled in the art that the present invention may be employed to transmit any desired electrical energy, including both signals and power. Also, the electrical energy may be transmitted from downhole to the surface. Electrical power may also be supplied to any electrical device for any desired downhole use.

The foregoing disclosure and description of the invention are illustrative and explanatory thereof, and various changes in the size, shape and materials as well as in the details of the illustrated construction may be made without departing from the spirit of the invention.

We claim:

1. An electrical power conductor unit apparatus adapted for use in the bore of a tubing joint formed drilling string to transmit electrical power to an electrical motor mounted in the drilling string, including:

an elongated electrical conductor for extending in the bore of a drilling string to a desired operating location and having a lower end and an upper end;

a lower connector plug means mounted on said lower end of said electrical conductor for electrically connecting with a connector plug disposed in the bore of the drilling string below said electrical conductor; and an upper connector plug means mounted on said upper end of said electrical conductor for electrically connecting with a connector plug disposed in the bore of the drilling string above said electrical conductor, said upper connector plug means having means for releasably securing said upper connector plug means with the drilling string to support said electrical conductor in the bore of the drilling string and releasable in response to predetermined engagement with a fishing tool for enabling removal of said electrical conductor from the bore of the drilling string with the fishing tool.

2. The apparatus as set forth in claim 1, wherein:

said electrical conductor is a substantially rigid member extending between said lower connector plug means and upper connector plug means.

3. The apparatus as set forth in claim 1, wherein:

said electrical conductor is a flexible cable means having an insulating jacket extending substantially between said lower connector plug means and said upper connector plug means.

4. The apparatus as set forth in claim 3, wherein:
said cable means having a plurality of three conductor wires surrounded by said insulating jacket between said lower connector plug means and said upper connector plug means.

5. The apparatus as set forth in claim 1, wherein:
said upper connector plug means is a male connector and said lower connector plug means is a female connector.

6. The apparatus as set forth in claim 1, wherein:
said lower connector plug means is weighted for positive electrical connection with the upper connector plug disposed in the bore below said electrical conductor.

7. The apparatus as set forth in claim 1, wherein:
said lower connector plug means mounts means for aligning said lower connector plug means for making electrical connection with the upper connector plug disposed in the bore below said electrical conductor.

8. The apparatus as set forth in claim 1, wherein:
said lower connector plug means having latch means for releasably mechanically securing said lower connector plug means in electrical contact with the upper connector plug disposed in the bore below said electrical conductor.

9. The apparatus as set forth in claim 1, wherein:
said lower connector plug means having means for releasably securing said lower connector plug means with a tubing joint of the drilling string to position said lower connector plug means for electrical contact with the upper connector disposed in the bore below said electrical conductor as the tubing joint is added to the drilling string.

10. The apparatus as set forth in claim 9, wherein:
said means for releasably securing said lower connector plug means having means for breaking at a predetermined force for releasing said lower connector plug means.

11. The apparatus as set forth in claim 9, wherein:
said means for releasably securing said lower connector plug means having a plurality of dogs movably mounted with said lower connector plug means, said plurality of dogs movable to seat in a locking recess formed in the bore of the tubing joint for securing said lower connector plug means with the drilling string and to move from the locking recess to release said lower connector plug means for movement through the bore of the drilling string.

12. The apparatus as set forth in claim 9, wherein:
said lower connector plug means and said upper connector plug means are connected by said electrical conductor to form an electrical power conductor unit substantially a single tubing joint in length.

13. The apparatus as set forth in claim 9, wherein:
said lower connector plug means and said upper connector plug means are connected by said electrical conductor to form an electrical power conductor unit substantially a predetermined number of tubing joints in length.

14. The apparatus as set forth in claim 1, wherein:
said upper connector plug means forming a threaded surface engagable by the fishing tool moving across the threads for securing said upper connector plug means with the fishing tool to impart an upwardly movement to said upper connector plug means with the fishing tool for effecting release of said means for securing.

15. The apparatus as set forth in claim 1, wherein:
said upper connector plug means is releasably secured in the bore of the drilling string to form an annular flow path in the bore about said upper and lower connector plug means and said electrical conductor for the circulation of drilling fluids through the bore of the drilling string.

16. The apparatus as set forth in claim 1, wherein:
the means for releasably securing includes a plurality of anchor flutes for engaging the drilling string to releasably secure the plug means with the drilling string to reduce interference of the flow of drilling mud through the drilling string.

17. The apparatus as set forth in claim 1, wherein:
the anchor flutes having resilient fingers for releasably engaging the drilling string.

18. The apparatus as set forth in claim 1, wherein:
resilient fingers are movable in a plane transverse to the longitudinal axis of the drilling string to releasably engage the drilling string to reduce the intereference with the flow of drilling mud through the drilling string.

19. The apparatus as set forth in claim 16, wherein:
the lower connector plug having means for releasably securing the lower connector plug means with the drilling string to support the electrical conductor in the bore of the drilling string and releasable in response to the predetermined engagement with the fishing tool for enabling removal of the electrical conductor from the bore of the drilling string with the fishing tool.

20. The apparatus as set forth in claim 19, wherein:
the releasable securing means for the lower plug having the means for releasably securing includes a plurality of anchor flutes for engaging the drilling string to reduce interference of the flow of drilling mud through the drilling string.

21. The apparatus as set forth in claim 20, wherein:
the anchor flutes for the lower plug having resilient fingers for releasably engaging the drilling string.

22. The apparatus as set forth in claim 21, wherein:
the resilient fingers for the lower plug are movable in a plane transverse to the longitudinal axis of the drilling string to releasably engage the drilling string to reduce the interference with the flow of drilling mud through the drilling string.

23. Electrical connector apparatus for use in a bore of a well conduit disposed in a well comprising:
an electrical connector plug means movable through the bore of the well conduit and having an electrically connected flexible electrical conductor cable extending downwardly therefrom;
said plug means being the terminal portion at the upper end of said conductor cable;
means for releasably securing said electrical connector plug means at a desired location in the bore of the well conduit to provide vertical support to the downwardly extending flexible electrical conductor cable and releasable in response to predetermined engagement with a fishing tool to enable movement of said electrical connector plug means and electrical conductor cable therebelow upwardly through the bore of the well conduit with the fishing tool;
the releasable securing means for the electrical connector plug means including a plurality of anchor means secured with the connector plug means for releasably engaging the drilling string.

24. An electrical conductor unit apparatus adapted for use in the bore of a tubing joint formed drilling string to transmit desired electrical energy in the drilling string, including:

an elongated electrical conductor movable through the bore of a drilling string to a desired operating location and having a lower end and an upper end;

a lower connector plug means mounted on said lower end of said electrical conductor for electrically connecting with a connector plug disposed in the bore of the bore of the drilling string below said electrical conductor; and an upper connector plug means mounted on said upper end of said electrical conductor for electrically connecting with a connector plug disposed in the bore of the drilling string above said electrical conductor, said upper connector plug means having means for releasably securing said upper connector plug means with the drilling string to support said electrical conductor in the bore of the drilling string and releasable in response to predetermined engagement with a fishing tool for enabling removal of said electrical conductor from the bore of the drilling string with the fishing tool.

25. The apparatus as set forth in claim 24, wherein:

said electrical conductor when operably disposed in said drilling string serving to conduct electrical power to a downhole electrical device.

26. The apparatus as set forth in claim 24, wherein:

said electrical conductor when operably disposed in said drilling string serving to conduct an electrical signal.

27. The apparatus as set forth in claim 23, wherein:

the anchor means for the means plug comprising resilient fingers for releasably engaging the drilling string and which are movable in a plane transverse to the longitudinal axis of the drilling string to permit release of the conductor and the cable therewith from the drilling string.

* * * * *